US006688054B2

(12) United States Patent
Pasterchick

(10) Patent No.: US 6,688,054 B2
(45) Date of Patent: Feb. 10, 2004

(54) DECK MASTER

(76) Inventor: Mark Pasterchick, 477 Bergen Ave., Washington Twp, NJ (US) 07675

( * ) Notice: Subject to any disclaimer, the term of this patent is extended or adjusted under 35 U.S.C. 154(b) by 0 days.

(21) Appl. No.: 09/941,436

(22) Filed: Aug. 28, 2001

(65) Prior Publication Data

US 2002/0023395 A1 Feb. 28, 2002

Related U.S. Application Data

(60) Provisional application No. 60/228,370, filed on Aug. 28, 2000.

(51) Int. Cl.[7] ..... E04C 2/38

(52) U.S. Cl. ..... 52/177; 52/716.1; 52/718.04; 52/717.04; 52/717.05

(58) Field of Search ..... 52/177, 650.3, 52/717.04, 730.7, 717.03, 717.05, 736.3, 718.04, 737.3, 737.4, 716.1

(56) References Cited

U.S. PATENT DOCUMENTS

| | | | | | |
|---|---|---|---|---|---|
| 965,595 | A | * | 7/1910 | Nicholson | 52/177 |
| 2,178,388 | A | * | 10/1939 | Beckman | 189/40 |
| 4,885,882 | A | * | 12/1989 | Forshee | 52/177 |
| 5,725,201 | A | * | 3/1998 | Parth | 256/24 |
| 5,794,390 | A | | 8/1998 | Oliveri et al. | |
| 5,913,784 | A | * | 6/1999 | Hite | 52/177 |
| 6,061,995 | A | * | 5/2000 | Menchetti et al. | 52/794.1 |
| 6,311,955 | B1 | * | 11/2001 | McGarry et al. | 256/24 |
| 6,374,555 | B1 | * | 4/2002 | Gusler | 52/177 |
| 6,453,630 | B1 | * | 9/2002 | Buhrts et al. | 52/177 |

* cited by examiner

*Primary Examiner*—Carl D. Friedman
*Assistant Examiner*—Jennifer I. Thissell
(74) *Attorney, Agent, or Firm*—Matthew J. Peirce

(57) ABSTRACT

A new and improved covering that can be used to cover any existing 2" by 6" decking of wood. The covering would be preferably made from vinyl and could also be used for picnic tables, docks, or any railing or wood surface that uses 2" by 6" pieces of wood.

3 Claims, 2 Drawing Sheets

DECK MASTER

This application claims the benefit of prov. application 60/228,370 filed Aug. 28, 2000.

BACKGROUND OF THE INVENTION

The present invention concerns that of a new and improved covering that can be used to cover any existing 2" by 6" decking of wood.

DESCRIPTION OF THE PRIOR ART

U.S. Pat. No. 5,794,390, issued to Oliveri et al., discloses a structural covering that is attachable to a rail of a railing that has a top, a pair of sides, ends, and a bottom.

U.S. Pat. No. 4,885,882, issued to Forshee, discloses a cover for a wooden deck structure which protects people walking on the deck structure from splinters.

SUMMARY OF THE INVENTION

The present invention concerns that of a new and improved covering that can be used to cover any existing 2" by 6" decking of wood. The covering would be preferably made from vinyl and could also be used for picnic tables, docks, or any railing or wood surface that uses 2" by 6" pieces of wood.

There has thus been outlined, rather broadly, the more important features of a deck covering in order that the detailed description thereof that follows may be better understood and in order that the present contribution to the art may be better appreciated. There are, of course, additional features of the deck covering that will be described hereinafter and which will form the subject matter of the claims appended hereto.

In this respect, before explaining at least one embodiment of the deck covering in detail, it is to be understood that the deck covering is not limited in its application to the details of construction and to the arrangements of the components set forth in the following description or illustrated in the drawings. The deck covering is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present deck covering. It is important, therefore, that the claims be regard as including such equivalent constructions insofar as they do not depart from the spirit and scope of the present invention.

It is therefore an object of the present invention to provide a deck covering which has all of the advantages of the prior art and none of the disadvantages.

It is another object of the present invention to provide a deck covering which may be easily and efficiently manufactured and marketed.

It is another object of the present invention to provide a deck covering which is of durable and reliable construction.

It is yet another object of the present invention to provide a deck covering which is economically affordable and available to the buying public.

It is yet another object of the present invention to provide a deck covering which provides additional benefits not present in the prior art.

Other objects, features and advantages of the present invention will become more readily apparent from the following detailed description of the preferred embodiment when considered with the attached drawings and appended claims.

DESCRIPTION OF THE PREFERRED EMBODIMENT

Figure 1:
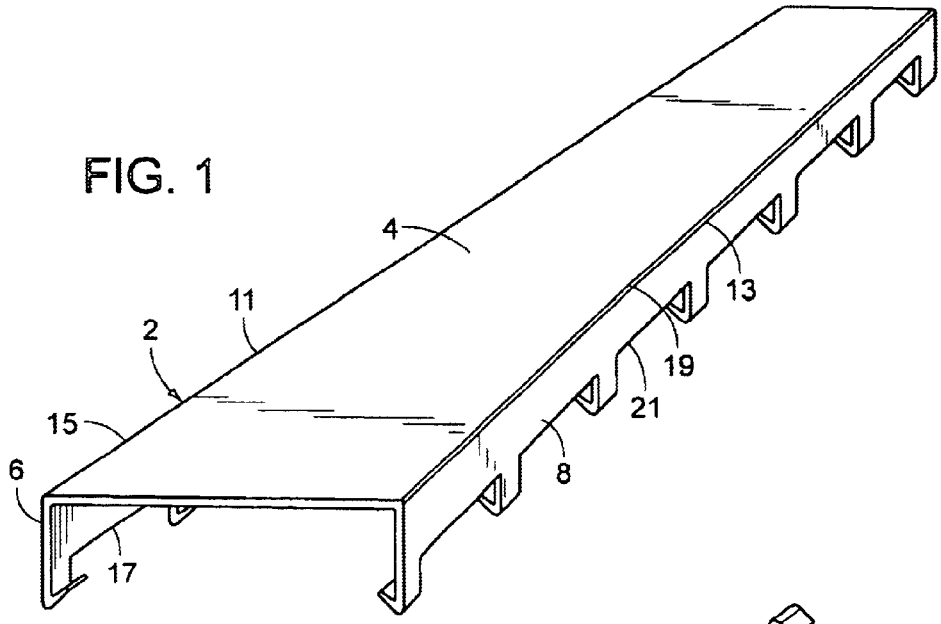
FIG. 1 shows a perspective top view of the present invention.
Figure 2:
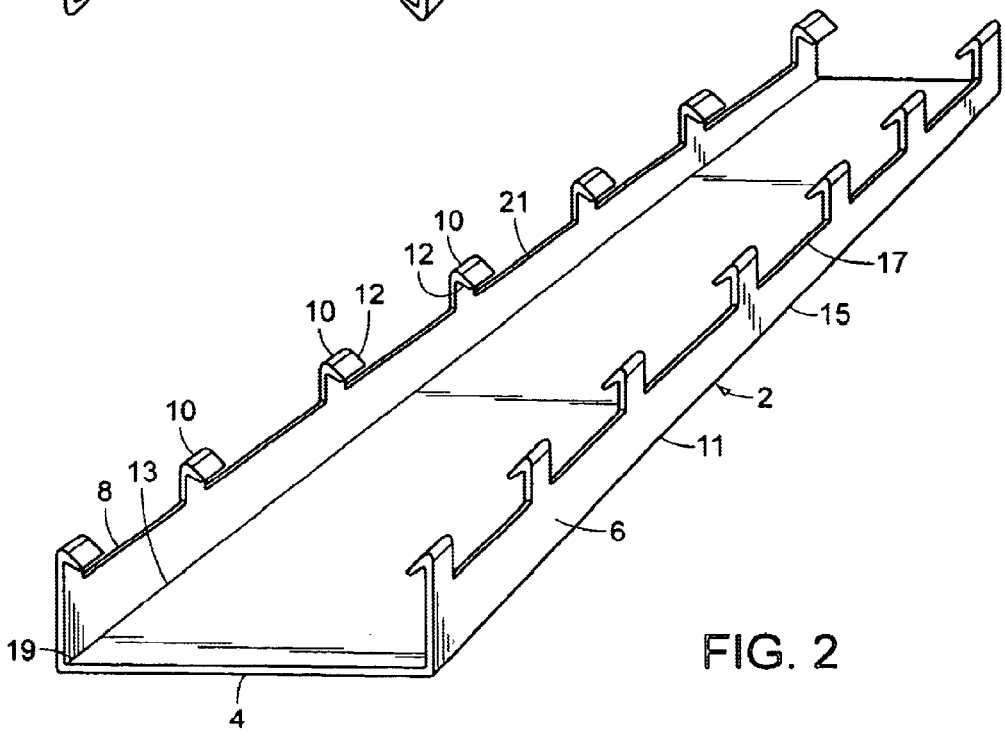
FIG. 2 shows a perspective bottom view of the present invention.

FIGS. 1 and 2 show perspective top view and perspective bottoms views, respectively, of the main segment 2 of the present invention. Main segment 2 would be of varied length and would be 5½ inches in width and 1⁹⁄₁₆ inches in height. Main segment 2 would have a top cover 4 and two side covers, a left side cover 6 and a right side cover 8. The top cover 4 would have two sides, a first side 11 and a second side 13. The left side cover 6 would have two sides, a first side 15 and a second side 17. The right side cover 6 would have two sides, a first side 19 and a second side 21. Both the left side cover 6 and the right side cover 8 would have a plurality of locking tabs 10 which would be attached to the second side of both the left side cover 6 and the right side cover 8. Each of the locking tabs 10 would have an inward extension 12, with each inward extension 12 extending inward and upward in a manner toward top cover 4.

Once main segment 2 has been placed on an appropriate 2" by 6" segment, both left side cover 6 and right side cover 8 would be long enough to allow each inward extension 12 on each locking tab 10 to be fully located under the 2" by 6" segment. At this time, each inward extension 12 on each locking tab 10 would extend inward and act as a small anchor which would hold main segment 2 to the appropriate 2" by 6" segment.

Figure 3:
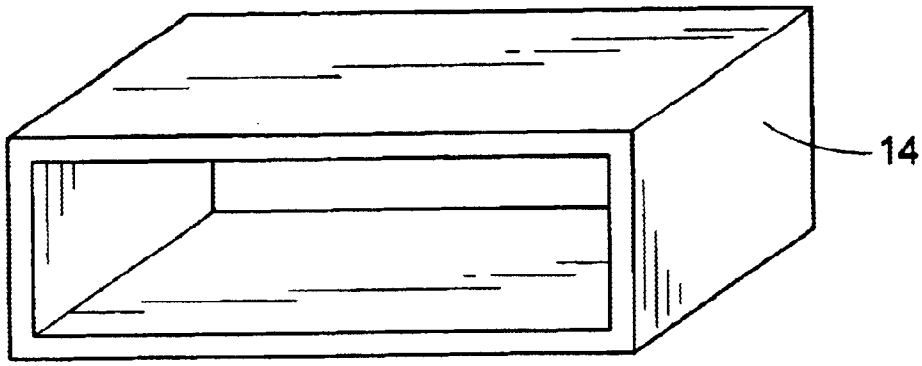
FIG. 3 shows a perspective bottom view of a union joinder of the present invention.

FIG. 3 shows a perspective bottom view of a union 16 of the present invention. Union 16 would be used to attach two main segments 2 to each other.

Figure 4:
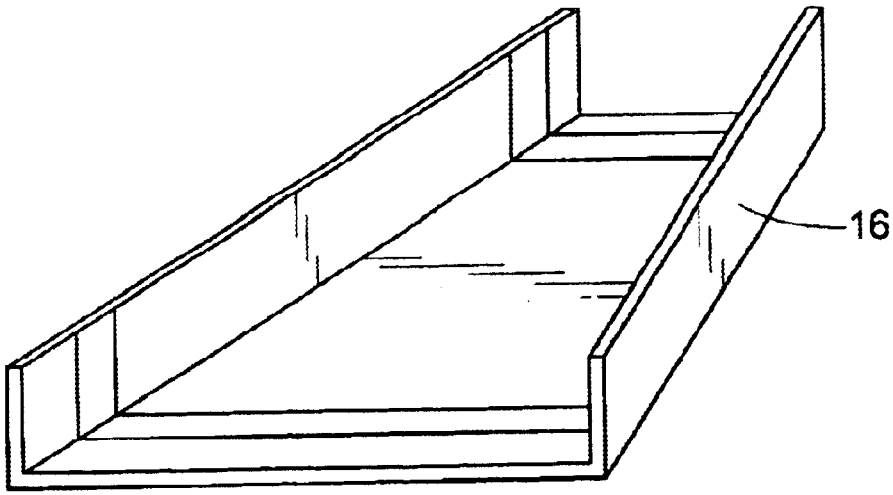
FIG. 4 shows a perspective view of an end cap of the present invention.

FIG. 4 shows a perspective view of an end cap 14 of the present invention. The end cap 14 would be placed on an exposed end portion of a 2" by 6" segment and would be designed to cap off any extra portion of the present invention which would not be covered by main segment 2.

What I claim as my invention is:

1. A covering for a two inch by six inch block of wood comprising:

(a) a top cover having a specific length, the top cover being five and one-half inches in width, the top cover having two sides, a first side and a second side, (b) a left covering having a specific length, the left cover having two sides, a first side and a second side, the first side of the left cover being attached to the first side of the top cover at a ninety degree angle, the left cover further comprising a plurality of locking tabs, the locking tabs being attached in a linear fashion to the second side of the left cover, the locking tabs being equidistant from one another, wherein each of the locking tabs on the second side of the left cover have an inward extension which extend inward and upward in relation to the top cover, and (c) a right covering having a specific length, the right cover having two sides, a first side and a second side, the first side of the right cover being attached to the second side of the top cover at a ninety degree angle, the right cover further comprising a plurality of locking tabs, the locking tabs being attached in a linear fashion to the second side of the right cover, the locking tabs being equidistant from one another, wherein each of the locking tabs on the second side of the right cover have an inward extension which extend inward and upward in relation to the top cover.

2. A covering for a two inch by six inch block of wood according to claim 1 in combination with a union joinder and a second covering, the union joinder being used to connect the covering to the second covering.

3. A covering for a two inch by six inch block of wood according to claim 1 in combination with an end cap, the end cap being used to cover an exposed end portion of a two inch by six inch block of wood.

* * * * *